United States Patent [19]

Eisman

[11] Patent Number: 4,951,865

[45] Date of Patent: Aug. 28, 1990

[54] PAPERBOARD CARTON WITH GUSSET LOCK

[75] Inventor: Larry Eisman, Elkins Park, Pa.

[73] Assignee: Dopaco, Inc., Downingtown, Pa.

[21] Appl. No.: 447,076

[22] Filed: Dec. 7, 1989

[51] Int. Cl.[5] ..... B65D 5/22

[52] U.S. Cl. ..... 229/146; 229/114; 229/149

[58] Field of Search ..... 229/114, 146, 149, 902, 229/906, 145

[56] References Cited

U.S. PATENT DOCUMENTS

| | | | |
|---|---|---|---|
| 1,681,940 | 8/1928 | Lander | 229/114 |
| 2,373,977 | 4/1945 | Scherer | 229/145 |
| 2,531,507 | 11/1950 | Goodyear | 229/145 |
| 2,713,963 | 7/1955 | Andrews et al. | 229/145 |
| 2,839,236 | 6/1958 | Dunning . | |
| 2,889,103 | 6/1959 | Kuchenbecker | 229/149 |
| 2,982,465 | 5/1961 | Fallert | 229/145 |
| 3,193,175 | 7/1965 | Moreton | 229/149 |
| 3,206,095 | 9/1965 | Stegner | 229/149 |
| 3,642,193 | 2/1972 | Rada | 229/149 |
| 3,642,194 | 2/1972 | Scully | 229/145 |
| 3,794,238 | 2/1974 | Egli | 229/145 |
| 4,252,267 | 2/1981 | Osborne | 229/149 |
| 4,339,068 | 7/1982 | Brauner | 229/23 BT |
| 4,472,896 | 9/1984 | Brauner et al. | 40/312 |
| 4,570,845 | 2/1986 | Hall | 229/146 |
| 4,763,832 | 9/1988 | Forbes, Jr. | 229/114 |

FOREIGN PATENT DOCUMENTS

| | | | |
|---|---|---|---|
| 574285 | 4/1959 | Canada | 229/145 |
| 1569002 | 6/1980 | United Kingdom | 229/145 |

*Primary Examiner*—Gary E. Elkins

*Attorney, Agent, or Firm*—Dennison, Meserole, Pollack & Scheiner

[57] ABSTRACT

A carton with an integrally hinged tray and cover assembled as a preform and including a lock flange on the front wall of the cover with projecting lock tabs engageable through corresponding slots in the front wall of the tray. The lock flange is gusset-engaged at the opposed ends thereof to the side walls of the cover, and seats on support shoulders on the opposed side walls of the tray to stabilize the flange, and hence the lock tabs thereon, in an extended position for engagement of the tabs within the corresponding slots when the cover is closed.

10 Claims, 4 Drawing Sheets

PAPERBOARD CARTON WITH GUSSET LOCK

BACKGROUND OF THE INVENTION

The fast food industry, and the necessity for disposable, inexpensive containers for foodstuffs, has resulted in the development of an appreciable number of different types of cartons, preferably of cardboard or paperboard.

In view of the substantial number of cartons utilized by the industry, and as the cartons are in fact "throw-away" items, much effort has been directed toward minimizing the amount of material used, and simplifying the formation and assembly steps. Similarly, inasmuch as fast food establishments, particularly ones with a high volume business, require the individual handling of a substantial number of cartons on a repetitive basis as the food is dispensed, designers of known cartons have strived to provide a carton which can be conveniently stored, quickly assembled to receive foodstuffs, and easily closed for presenting to the consumer or customer. Other considerations, from the viewpoint of the customer, have been the provision of a carton which is stable, with a substantially degree of strength and structural rigidity notwithstanding the thin nature of the actual material used, and which can be easily opened for access to the contained foodstuffs.

SUMMARY OF THE INVENTION

The carton of the present invention improves on the known and commercially available constructions to the benefit of all parties involved with the carton, the manufacturer of the carton, the user of the carton, that is the supplier of the fast food, and the ultimate customer.

More specifically, the unitary blank from which the carton is formed utilizes a minimum amount of material and is configured for formation on known forming equipment into a preformed and glued construction defining a clam shell carton comprising a hingedly interconnected tray and cover. The formed carton, delivered to the user as a preform, is nestable for a minimizing of shipping and storage requirements both by the manufacturer and the user.

The user, that is the fast food supplier, is required to fold only a single flange to ready the carton for closing after reception of the foodstuff. This is an easily effected maneuver with the flange being configured for automatic retention in its operative position at right angles to the adjacent wall.

Following the introduction of the foodstuff into the carton, the construction of the carton is such as to enable the server to close and lock the carton using only one hand with the inherent resiliency of the paperboard material allowing for a snap-engagement of the lock. The cover, through the lock and adjoining wall portions, is fixed into a set position against movement either inwardly relative to the tray such as might crush the received foodstuff, or to an open position until such time as the cover is manually released by the customer. Notwithstanding the effectiveness of the lock, release of the cover can be easily effected by one hand, as can reengagement of the lock as desired for a resealing of the carton.

Basically, the preformed carton is of a clam shell construction including integrally formed and hinged tray and cover components. The lock assembly is defined by releasably interengaging tabs and slots on the outer or front transverse walls of the cover and tray respectively. The front wall of the cover includes a full length flange which is secured by inwardly folding gussets to the cover side walls which in turn fix the folded flange in a position generally paralleling the top panel of the cover. Upon a folding of the flange, the locking tabs, integral and coplanar with the flange, extend outwardly from the front wall. The front wall of the tray includes the slots or apertures therethrough toward the upper end of the tray and positioned to receive the tabs upon a downward swinging of the cover with the front wall of the cover, and the flange, received immediately inward of the front wall of the tray. Inherent resilient flexibility of the two front walls enables a snap locking of the tabs through the slots. At the same time, the outer gusset-supported ends of the flange seat on and within positioning notches provided in the opposed side walls of the tray immediately adjacent the front wall thereof. Thus positioned, multiple advantages are achieved including a positive limit to both downward and front-to-rear movement of the cover, and a rigidification of the flap to preclude shifting thereof or any tendency for the gussets to unfold.

Other objects and advantages of the invention will be noted as residing in the details of construction as more fully hereinafter described and claimed.

DESCRIPTION OF PREFERRED EMBODIMENT

Figure 1:
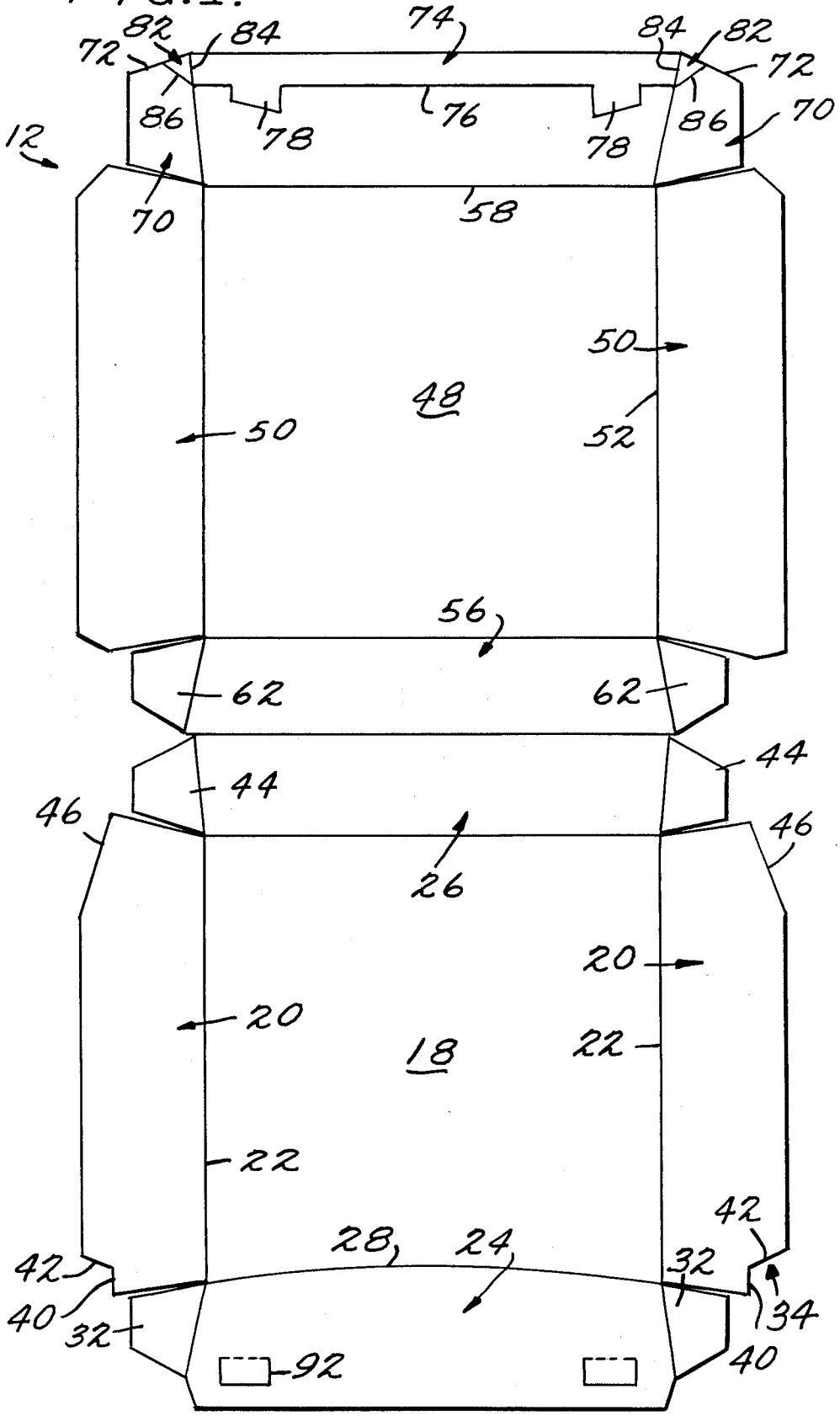
FIG. 1 is a plan view of the unitary blank from which the carton of the invention is formed.

The carton 10, formed from a unitary or one-piece blank 12 of paperboard or like material, is of a clam shell configuration comprising a tray 14 and a cover 16 hinged thereto.

The blank 12 is configured for formation of the carton 10 using standard forming equipment, with the formed carton being fully nestable and capable of compact stacking for shipping and storage convenience.

The tray 14 is defined by a substantially rectangular bottom or bottom panel 18, opposed side walls 20 integrally joined to opposed parallel side edges of the bottom 18 along fold lines 22, and opposed front and rear walls 24 and 26 integrally joined with the outer and inner edges of the bottom 18 along fold lines 28 and 30 respectively. The front wall fold line 28, and hence the outer edge of the otherwise rectangular bottom 18, is inwardly curved to form a slight bow in the outer wall 24 for enhanced rigidity and stability in its carton-defining position.

The opposed side walls 20 are of equal height with the front wall 24 and, in the erected or preformed carton 10, are secured thereto by glue flaps 32 integral with the opposed ends of the front wall 24 and rearwardly folded to lie immediately inward of the forward end portions of the side walls 20 to which the glue flaps 32 are bonded.

Figure 2:
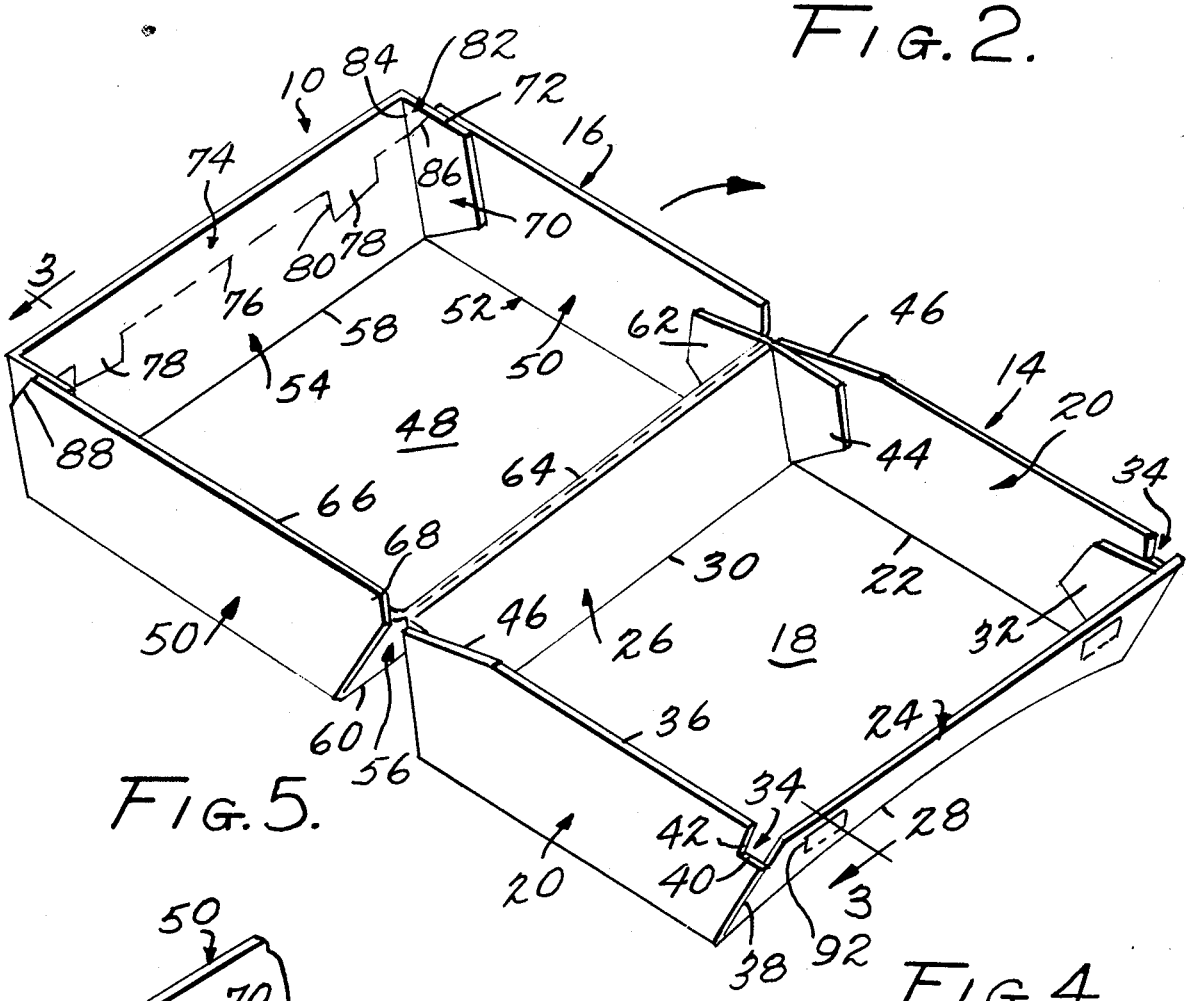
FIG. 2 is a perspective view of the preformed carton.

Each side wall 20, at the forward end portion thereof, includes a notch 34 of generally right angular configuration and opening through both the upper and forward side wall edges 36 and 38 respectively. Each notch 34 defines a support edge or shoulder 40 generally paralleling the upper edge 36 at a point below this edge approximately one quarter of the height of the side wall 20. The vertical edge 42 of each notch 34 is preferably inclined slightly rearward, providing a generally enlarged open upper end to the notch 34. As will be appreciated from FIGS. 2 and 9, in particular, the glue flaps 32 are cut so as to overlie the corresponding side walls 20 below the notches 34.

The rear wall 26 of the tray 14 is of a slightly lesser height than the side walls 20 and includes end glue flaps 44 which, in the erected carton, overlie the inner faces of the rear end portions of the side walls 20 and are bonded thereto for a mutual retention of the erected side walls and rear wall. The upper edge 36 of each side wall 20, at the rear portion thereof, tapers or is slightly beveled, at 46, to meet the upper edge of the rear wall 26.

The relationship of the four walls of the tray 14 are such whereby each wall inclines slightly outward to define a stacking configuration.

The cover 16 includes a top or top panel 48 with opposed side walls 50 integrally joined along the opposed side edges thereof by fold lines 52, and opposed outer and inner or front and rear walls 54 and 56 integrally joined to the corresponding edges of the top 48 along fold lines 58 and 60 respectively.

The rear wall 56 is fractionally longer than, but otherwise generally duplicates, the rear tray wall 26 and includes integral end glue flaps 62 which, in the preformed carton, overlie and are bonded to the inner faces of the opposed side walls 50. The two inner or rear walls 26 and 56 are integrally joined along their common upper edge by a fold line 64 defining a hinge for a selective closing of the cover 16 over the tray 14 as shall be explained subsequently.

Figure 10:
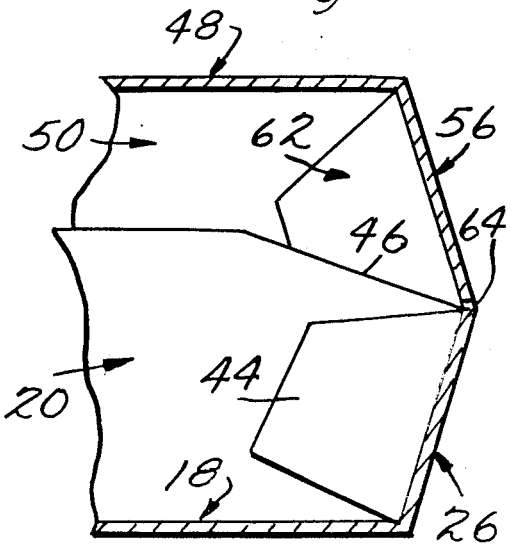
FIG. 10 is an enlarged cross-sectional detail taken through the rear of the closed carton and substantially on a plane passing along line 10—10 in FIG. 6.

The side walls 50 are of approximately equal height with the side walls 20 of the tray 14 and include linear upper edges 66 which define corners 68 at the leading inner ends of the side walls 50 above the height of the beveled inner ends of the tray side walls 20. These leading corners 68, in conjunction with the fractionally longer rear wall 56 of the cover 16, ensure a proper movement of the cover walls 50 to the outer sides of the corresponding tray walls 20 as the cover is closed. As will be appreciated from FIG. 10, the beveled edge portions 46 allow for an unencumbered swinging movement of the cover to the closed position.

The cover front wall 54 is of equal height with the side walls 50 and includes a pair of integral end glue flaps 70 which fold rearwardly for bonding to the inner surfaces of the side walls 50 to form a portion thereof adjacent the outer ends thereof. The glue flaps 70, at the fold line with the front wall 54, are of equal height with the front wall 54 and present upper edges 72 coplanar with the upper edges of the outer wall 54 and adjacent side walls 50.

A lock flange 74 is defined along the upper portion of the front wall 54 by a horizontal fold line 76 paralleling the upper edge of the wall 54. The fold line 76 is interrupted at two longitudinally spaced points along the length thereof. At each point, a depending tab 78 is formed integral and coplanar with the flange 74 and is defined from the front wall 54. The tabs 78, other than for the integral joinder thereof to the flange 74, are severed from the front wall 54 by cut lines 80 through the wall. Alternatively, the tabs 78 can be defined by severable lines easily broken upon a folding of the flange 74 as shall be described presently.

A triangular gusset 82 is provided in the upper outer corner of each of the glue flaps 70 and is defined by that portion 84 of the fold line between the front wall 54 and glue flap 70 which is coextensive with the height of the lock flange 74. The edge of each gusset 82 extending along the upper edge 72 of the corresponding glue flap 70 is of substantially equal length with the vertical fold line portion 84 to define an equilateral triangle with the hypotenuse thereof also defined by a fold line 86. As illustrated, the upper outer corner of each of the cover side walls 50 is beveled, defining a corner edge 88 coextensive with the corresponding gusset fold line 86 both to allow for a free pivoting of the gusset 82 to its folded position, and to avoid a projecting corner as might interfere with a closing of the carton.

Figure 5:
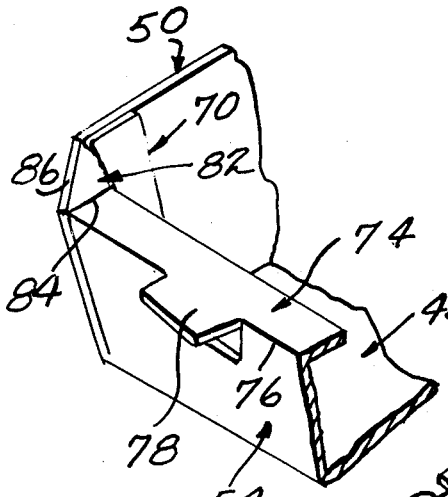
FIG. 5 is a further perspective detail of the lock flange.
Figure 4:
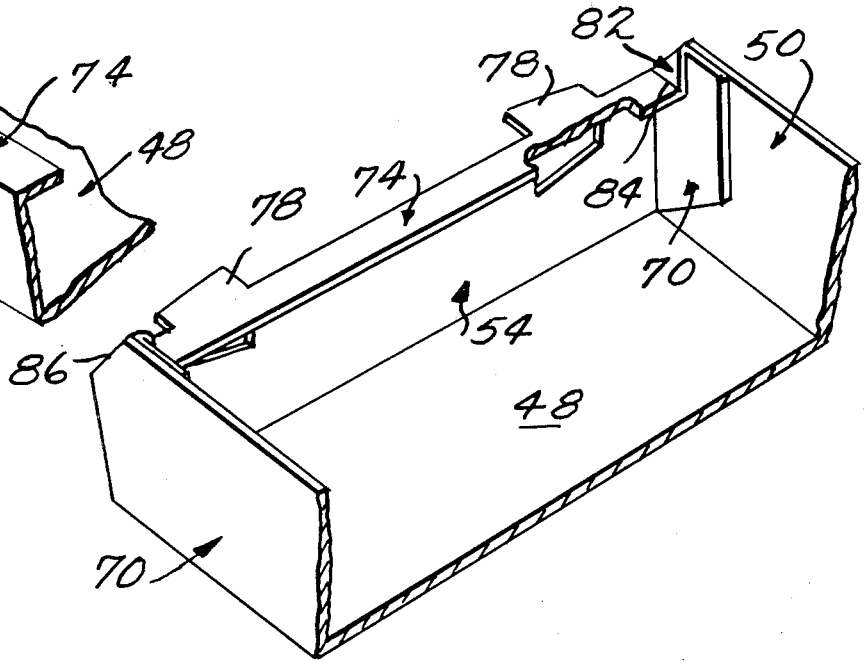
FIG. 4 is a perspective detail of the front end of the carton cover with the lock flange folded into operative position.
Figure 6:
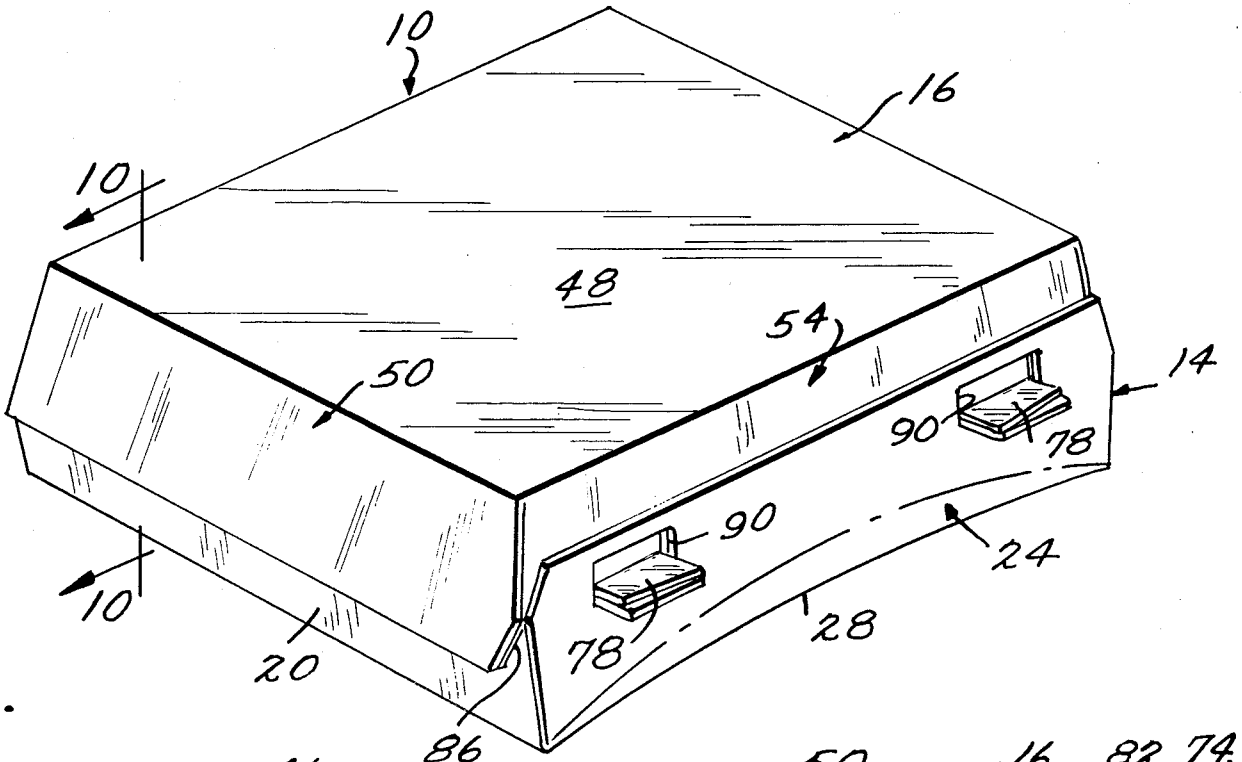
FIG. 6 is a perspective view of the closed and locked carton.
Figure 3:
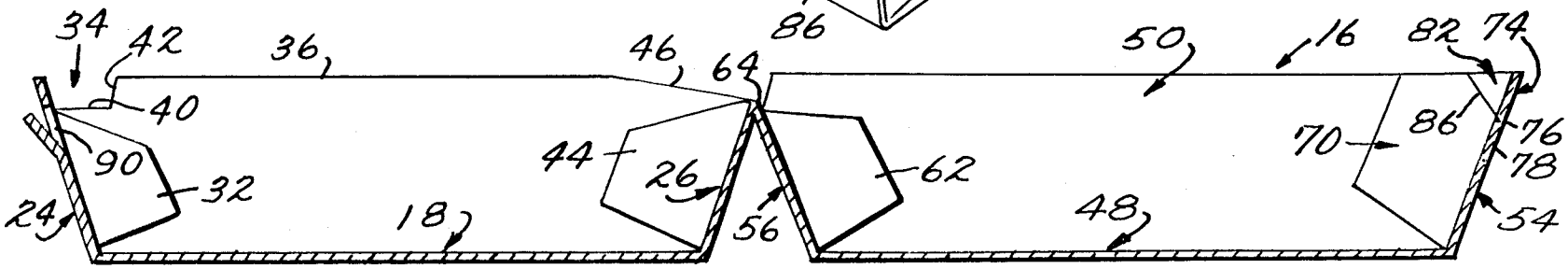
FIG. 3 is a longitudinal cross-sectional view taken substantially on a plane passing along the line 3—3 in FIG. 2.

When the carton 10 is to be used by the seller of the fast food or the like, the lock flange 74 is manually inwardly folded along fold line 76 with the gusset 82 inwardly pivoting, as best noted in FIGS. 4 and 5, to lie against the inner faces of the corresponding glue flaps 70, with the fold line portions 84, between the flange 74 and the gussets 82, moved between the initial vertical position to the horizontal position. The flange 74 itself projects horizontally inward or rearward relative to the front wall 54 with the tabs 78 extending horizontally forward or outward, having separated from the front wall 54 along the cut lines 80 simultaneously with the inward folding of the flange 74. The gussets 82 are considered of particular significance in providing for a positive stabilization of the folded flange 74, and hence the locking tabs 78, against any tendency for movement in any direction. That is, the gussets 82 will resist any tendency for the flange 74 to fold beyond the horizontal position of FIGS. 4 and 5, and will simultaneously, due to the inverted positioning of the gussets 82, resist any tendency for the flange 74 to unfold or resume its original position.

In order to accommodate the projecting lock tabs 78 in the closed position of the carton, the front wall 24 of the tray 14 is provided with a pair of apertures or slots 90 therethrough formed by appropriate cut lines 92 in the blank 12. The cut lines 92 either completely sever the material to define the slots 90 or provide readily severable means whereby the slots are automatically formed as the locking tabs 78 align therewith and outwardly fold or release the material encompassed by the lines 92. As suggested in FIGS. 6–9, the material of the slot 90 is preferably folded outward and retained, thereby avoiding the necessity of disposing of this material in the manufacturing procedure.

Figure 7:
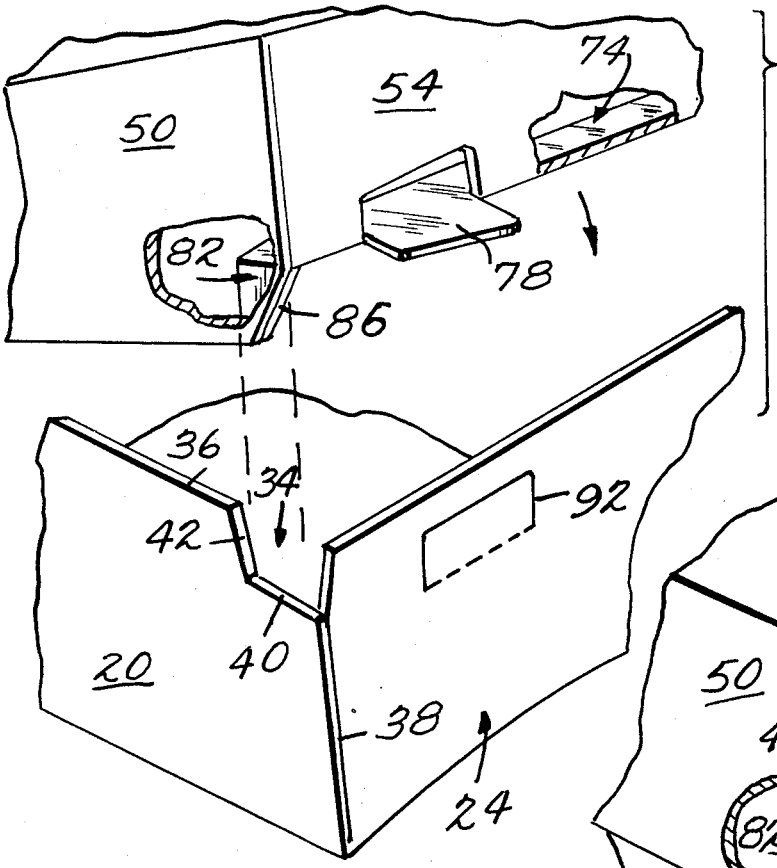
FIG. 7 is a perspective detail, with portions broken away, of the carton tray and cover just prior to closing.
Figure 8:
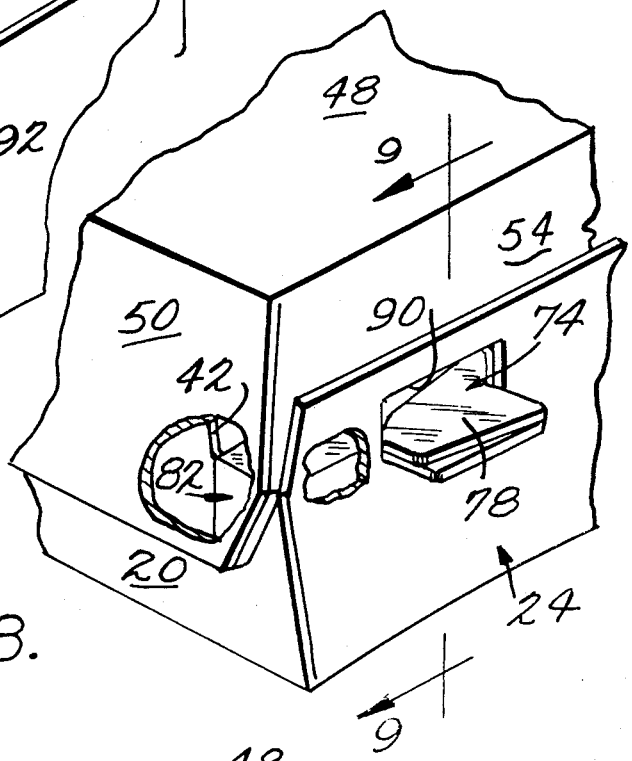
FIG. 8 is a perspective detail, with portions broken away, of the locked carton.
Figure 9:
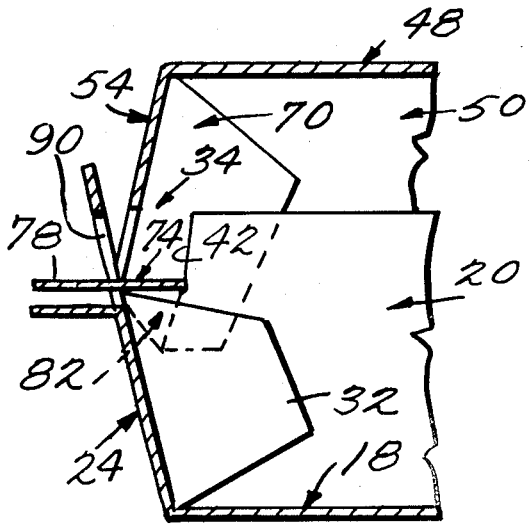
FIG. 9 is an enlarged cross-sectional detail taken substantially on a plane passing along line 9—9 in FIG. 8.

Noting FIGS. 7, 8 and 9 in particular, it will be seen that as the cover 16 is folded over the tray 14, the side walls 50 of the cover are positioned outward of the respective side walls 20 of the tray 14. The front wall 54 of the cover 16 with the in-turned locking flange 74 and outwardly directed tabs 78, is received immediately inward of the front wall 24 of the tray 14 with the flexible nature of the paperboard material allowing for a sliding of the tabs 78 along the inner surface of the front wall 24 until these tabs snap-lock into and through the aligned slots 90. When so positioned, inwardly directed flange 74, immediately adjacent the opposed gussets, seats on the opposed notch shoulders 40. This engagement of the lock flange 74 with the shoulders 40 fixes the position of the flange 74 and prevents further inward movement of the cover into the tray as might interfere with the contents of the carton. Similarly, any tendency for the flange to unfold is further resisted by the shoulders 40 and the cooperative relationship with the snap-engaged tabs 78. Finally, with the shoulder edge 40 of each notch 34 being of a length generally sufficient only to accommodate said flange 74, the flange 74 is retained between the vertical notch edges 42 and the front wall 24 to prevent a front to rear shifting of the cover 16 relative to the tray 14 and any tendency for the tabs 78 to unintentionally disengage from the slots 90.

While the folded flange 74 and the shoulder 40 have been illustrated as substantially horizontal, in some instances to obtain a stronger lock the folded flange 74, and tabs 78 thereon, may be angled slightly downward in an outward direction. This is accomplished by changing the angle of each gusset 82 by reducing the length of gusset edge along the upper edge 72 of the glue flap 70. The shoulders 40 will be similarly inclined.

Inasmuch as the forward wall 24 of the tray 18 is slightly inwardly bowed for enhanced rigidity and structural stability, the leading edges of the lock tabs 78, as illustrated, can be slightly angled to follow the curvature of the wall 24 and thus facilitate engagement within the aligned slots 90.

In view of the highly stable relationship between the tray 14 and the closed cover 16, resulting from the gusset supported flange 74 and the supported position thereof on the shoulders 40 of the opposed side walls 20 of the tray 14, the carton is formed with a minimal amount of material and does not require a complete vertical overlapping of the side walls 20 and 50 for strength.

Inward movement of the cover 16 relative to the contents of the tray 14 is limited in a positive manner and avoids any tendency to crush or disrupt the foodstuff. In conjunction therewith, inasmuch as the actual interlock of the tabs 78 with the slots 90 occurs toward the upper end of the front wall 24 of the tray 14, and as this outer wall 24 inclines outward, there will be no interference between the lock flange 74 and the foodstuff, thus avoiding a problem frequently encounted in paperboard cartons where the interlock is actually provided at the base of the cooperating walls. In the closed carton, the internal height thereof is essentially the combined height of the tray and cover whereby a maximum carton chamber is obtained.

The closing of the cover 16 requires only a single hand in that the lock tabs 78, upon a downward movement of the cover over the tray, will automatically engage within the lock slots 90 and, once engaged, are fixed therein through the stabilizing flange 74 and the relationship of the flange 74 to the opposed side wall notches 34 and support shoulders 40. To open the cover, one need merely flex the front walls 24 and 54 and upwardly swing the cover, the inerent flexibility of the material allowing the tabs to withdraw from the slots under positive manual pressure. The carton can be readily reclosed as desired.

While two locking tabs 78 with cooperating slots 90 have been illustrated, it is also conceivable that a single tab and slot interlock can be provided, or, alternatively, more than two interlocks. Further, the bonding of the glue flaps, while normally by adhesive, can be effected by other means, for example, ultrasonic bonding of special coatings.

The foregoing is illustrative of the principals of the invention. Such variations thereof as may occur to those skilled in the art are to be considered within the scope of the invention.

I claim:

1. A carton for foodstuffs and the like comprising a tray and a cover for said tray; said tray comprising a bottom panel with upstanding peripheral walls thereabout, said walls including a front wall, and a pair of opposed side walls joined to and extending from said tray front wall; said cover comprising a top panel with depending peripheral walls including a front wall and a pair of opposed side walls jointed to and extending from said cover front wall; said cover front wall including rearwardly directed flange means remote from said top panel, said flange means being joined to said opposed cover side walls, locking tab means integral with said flange means and extending forwardly of said cover front wall; said cover being selectively closable over said tray with the cover front wall received inward of and adjacent to said tray front wall, and with said cover side walls received outward of and adjacent to said tray side walls; said tray front wall including slot means defined therethrough and aligned with said tab means, said slot means receiving said tab means outwardly therethrough upon a closing of said cover over said tray, each said tray side wall including an upwardly directed shoulder adjacent said tray front wall, said cover flange means seating on said shoulders upon a closing of said cover over said tray and upon reception of said tab means through said slot means for stabilization of said flange means and said tab means.

2. The carton of claim 1 wherein said tray front wall includes an upper edge, said slot means being within the upper portion of the tray front wall below the upper edge thereof, each said tray side wall including an upper edge, a notch defined in each tray side wall through the side wall upper edge and immediately adjacent the tray front wall, said notch forming said shoulder in downwardly spaced relation to the tray side wall upper edge.

3. The carton of claim 2 including hinge means joining said cover to said tray for pivotal movement of the cover between an open position remote from said tray and a closed position over and engaged with said tray.

4. A carton formed from a unitary folded blank, said carton comprising a tray and a cover; said tray comprising a bottom panel, opposed front and rear walls integral with said bottom panel, opposed side walls integral with said bottom panel and extending between and joined to said front and rear walls, said front wall having at least one locking aperture means defined therethrough in upwardly spaced relation to said bottom panel, said side walls, adjacent said front wall, each having an upwardly directed notch defined therein, said notches forming a pair of upwardly directed shoulders at approximately equal height with said at least one locking aperture means; said cover comprising a top panel, opposed front and rear walls integral with said top panel, and opposed side walls integral with said top panel and joined to and extending between said cover front and rear walls, said cover front wall including an outer flange coextensive therewith and defined by a flange fold line paralleling said top panel in outwardly spaced relation thereto for a selective inward folding of the flange relative the cover front wall, said flange including at least one integral locking tab depending below said flange fold line whereby upon an inward folding of said flange, said at least one locking tab folds upward and outward coplanar with the inwardly folded flange, said at least one locking tab being in substantial alignment with said at least one locking aperture means for selective reception therein upon a closing of said cover over said tray; said flange, adjacent the cover side walls, aligning with the notches in the tray side wall and engaging against the shoulders therein when the cover is closed over said tray, said flange engagement with said notch shoulders defining the closed position of said cover.

5. The carton of claim 4 wherein each of said tray side wall notches includes a substantially vertical inner edge, said flange, in the closed position of the cover, being confined between each notch inner edge and the tray front wall whereby front-to-rear shifting of the flange and the cover is restricted.

6. The carton of claim 5 wherein the rear walls of the tray and cover include upper edges integrally joined along a fold line to define a hinge for movement of the cover between open and closed positions.

7. The carton of claim 6 including a generally triangular folding gusset formed in each cover side wall adjacent the corresponding end of the flange, each gusset being formed by a first gusset fold line extending outward of said flange fold line between the corresponding end of the flange and the cover side wall, said gusset fold line being of equal height with said flange, and a second gusset fold line extending from the flange fold line rearwardly and outwardly at an angle across the corresponding cover side wall, said gussets folding inwardly in response to inward folding of the flange and defining a stabilizing support for the inwardly folded flange.

8. The carton of claim 7 wherein the opposed cover side walls include glue flaps integral with the opposed ends of the cover front wall, said gussets being defined in said glue flaps.

9. The carton of claim 4 including a generally triangular folding gusset formed in each cover side wall adjacent the corresponding end of the flange, each gusset being formed by a first gusset fold line extending outward of said flange fold line between the corresponding end of the flange and the cover side wall, said gusset fold line being of equal height with the flange, and a second gusset fold line extending from the flange fold line rearwardly and outwardly at an angle across the corresponding cover side wall, said gussets folding inwardly in response to inward folding of the flange and defining a stabilizing support for the inwardly folded flange.

10. The carton of claim 9 wherein the opposed cover side walls include glue flaps integral with the opposed ends of the cover front wall, said gussets being defined in said glue flaps.

* * * * *